US007946379B1

(12) United States Patent
Frenchik

(10) Patent No.: US 7,946,379 B1
(45) Date of Patent: May 24, 2011

(54) FILTER ASSEMBLY

(76) Inventor: Michael Frenchik, Calabasas, CA (US)

( * ) Notice: Subject to any disclaimer, the term of this patent is extended or adjusted under 35 U.S.C. 154(b) by 0 days.

(21) Appl. No.: 12/467,239

(22) Filed: May 15, 2009

Related U.S. Application Data

(63) Continuation-in-part of application No. 11/480,650, filed on Jul. 3, 2006, now abandoned.

(51) Int. Cl.
*H04R 11/04* (2006.01)
*H04R 9/08* (2006.01)

(52) U.S. Cl. ..... 181/158; 381/359

(58) Field of Classification Search ..... 181/158; 381/359, 361, 366, 368; D14/226, 229
See application file for complete search history.

(56) References Cited

U.S. PATENT DOCUMENTS 2,106,813 A * 2/1938 Romanow ..... 381/347
4,570,746 A * 2/1986 Das et al. ..... 381/359
4,975,966 A * 12/1990 Sapiejewski ..... 381/189
5,604,961 A * 2/1997 Cole ..... 24/306
D396,862 S * 8/1998 Morgan ..... D14/225
D450,684 S * 11/2001 Morgan ..... D14/226
6,467,132 B1 * 10/2002 Robley ..... 24/16 PB
6,622,820 B2 * 9/2003 Pavlovic ..... 181/242
6,724,904 B1 * 4/2004 Winter ..... 381/361
D525,238 S * 7/2006 Hannapel ..... D14/226

FOREIGN PATENT DOCUMENTS

GB 2386497 A * 9/2003

* cited by examiner

*Primary Examiner* — Jeffrey Donels
*Assistant Examiner* — Jeremy Luks
(74) *Attorney, Agent, or Firm* — Patent Law Agency, LLC; Peter Ganjian

(57) ABSTRACT

The present invention discloses a filter assembly for filtering pop noise during a recording session, having a frame that forms the outer perimeter of the filter assembly, the frame comprising a first frame structure and a second frame structure. Further included is a filter diaphragm enclosed in between the first frame structure and the second frame structure of the frame, and a strap comprised of a second soft material that is coupled with the frame for detachably coupling the frame with a microphone.

21 Claims, 13 Drawing Sheets

FILTER ASSEMBLY

CROSS-REFERENCE TO RELATED APPLICATIONS

This application is a Continuation-In-Part application claiming the benefit of priority of the co-pending U.S. Utility Non-Provisional patent application Ser. No. 11/480,650, with a filing date of Jul. 3, 2006, the entire disclosures of which is expressly incorporated by reference in its entirety herein.

BACKGROUND OF THE INVENTION (1) Field of the Invention

The present invention is directed to microphone filters and, more particularly, to a microphone pop filter assembly.

(2) Description of Related Art

A pop filter is used between a sound source (e.g., from a person) and a microphone to reduce the effects of "pops" or other similar obtrusive sounds from being recorded. Pops or other obtrusive sounds are generated when vocal sounds (such as for example when the letter "P" or "B" is pronounced) produce air thrust (or blast), resulting in an explosive or "pop" sound. The pop sound within a recording is obviously not usable, and hence, the need for filtering the pop sound for a clean recording. The pop filter filters this popping noise so that it is not recorded by the microphone.

Conventional microphone pop filter assemblies and microphone pop filter support assemblies have been known and in use for a number of years. Reference is made to the exemplary U.S. Pat. No. 6,724,904 to Winter, the entire disclosure of which patent is incorporated by reference herein, and parts of which are illustrated as FIGS. 1A to 1D, and described below.

FIG. 1A is a perspective view of a prior art filter mounting assembly 100 and a filter assembly 102. As illustrated, the conventional filter assembly 102 requires a conventional filter mounting assembly 100, with the filter mounting assembly comprising two elongated bars or rods 116*a* and 116*b* each of which may have multi-sided configuration, and wherein the bars 116*a* and 116*b* may be of equal or different lengths. A plurality of connectors 110 are attached at various locations on the respective bars 116*a* and 116*b*, and are structured to be secured to one another by a set of connectors 110*a*. One or more adjustment knobs 112 allow pivotal movement or attachments of the connectors 110 and 110*a* to one another and to the filter assembly 102. The filter mounting assembly 100 is coupled to a base unit 104, which holds a microphone 106 via the microphone shock mount assembly 108. Other prior art mounting assemblies include a well-known metallic, flexible "gooseneck," which couple the filter assembly 102 to some stand (independent standalone stand or a microphone stand).

FIG. 1B is a perspective view of a prior art filter assembly 102 that is illustrated in FIG. 1A. The filter assembly 102 is also known as a "pop filter," and includes a circular or annularly configured brace 122 removably secured into a closed configuration by a separable connector 114, with the connector 114 having a receiving pocket or channel therein, forming a female coupler 120. The brace 122 is generally comprised of plastic, wood, metal, or other solid or rigid material. In general, the separate connector 114 is comprised of metal, with the channel or pocket 120 having grooves for screwing on the filter assembly 102 onto the filter mounting assembly 100. That is, the brace 122 is attached to one of the bars 116*a* or 116*b* or connected to a correspondingly disposed connector 110 of the filter mounting assembly 100. As best illustrated in FIG. 1C, the filter assembly 102 is further comprised of a filter material or diaphragm 130, extending across and effectively covering the central opening of the peripheral portion 126. As best illustrated in FIG. 1D, filter material or diaphragm 130 is comprised of spaced apart filters 130.

Regrettably, conventional microphone filter assemblies and microphone filter support assemblies suffer from obvious disadvantages in that they are rigid and require complex and bulky mechanical contraptions to assemble and be used. Due in part to their bulk, the prior art microphone filter support assemblies add clutter and take on too much space in a recording studio. The prior art filter support assemblies may generally be coupled with a microphone stand such as in the prior art FIG. 1A (or via a gooseneck connector), or be coupled onto an independent stand. However, they are generally not coupled directly with the microphone. Professional recording microphones are very expensive, and most users do not desire and hesitate to directly couple a much less costly pop filter with an expensive microphone, which may accidentally damage the microphone during use. The problem with the accidental damage is not resolved by a mere indirect connection, and in fact, is compounded because of the clutter created by the microphone filter support assembly and the microphone filter assembly, which when accidentally touched, may strike the microphone (due to close proximity therewith), damage it, and create unwanted sound during recording. In addition, it is obvious that the hard rigid surfaces of the microphone filter assembly and that of microphone filter support assembly may scratch the microphone if or when these assemblies come into contact with the microphone.

A further reason for using additional, independent microphone filter support assembly stands is that the rigid materials from which the microphone filter assembly and the microphone filter support assemblies are made may vibrate during recording due to noise level of the sound that is being recorded or when they are accidentally bumped. The vibration moving up through the floor due to bumping or the recording sound is translated as undesired noise into the microphone if the microphone filter assembly and its support assembly are coupled directly with the microphone. When independent stand is used, the vibration is directed to the ground, rather than the microphone. In fact, it should be noted that many of the professional microphones are placed or suspended within shock mounts 108 (FIG. 1A) to prevent undesired recording effects due to vibrations. The shock mount itself is another component that takes on space, and causes the location of the pop filter to be at a further distance from the microphone, which reduces the quality of the sound being recorded. In general, it is desirable to place the pop filters as close to the microphone as possible so to enable the users to be as close to the microphone as possible for best recording.

As illustrated in FIGS. 1A to 1D, most prior art microphone filter assemblies are comprised of rigid material (such as metal, wood, plastic, etc.) surrounding the periphery 122 and 126, which in most cases reflect sound that is directed thereto. In order to avoid the recording of this reflected sound from the rigid frame, most of today's pop filters are designed to be larger than the actual size of the microphone with which they are associated. This way, most sound reflected from off the periphery of the microphone filter assembly is not redirected to the microphone for recording. However, the large size of the prior art pop filters provide for a false target for the user to aim the sound when recording. The professional recording microphones have a very small capsule or core (e.g., approximately 1 inch in diameter), and are very sensitive to slightest variations of sounds. The larger pop filters may cause the users to perceive that they can move away and continue to remain within the appropriate range of recording of the actual microphone without affecting the recording quality. In general, with most prior art pop filters, most users do end up moving away from the microphone during recording, perceiving that they are still within the appropriate recording range. It should be noted that the users may have only moved two to three inches or less away from the microphone capsule, which in most cases may be sufficient to cause the recording to sound like a mistake compared to the rest of the performance when the users were aiming their voice straight at the microphone. Hence, the large size of the prior art pop filters reduces or eliminates sound reflections from being recorded, but creates a false "safety zone" of recording, reducing the quality of recorded sound.

In light of the current state of the art and the drawbacks to current microphone filter assemblies and microphone filter support assemblies mentioned above, a need exists for a filter assembly and a filter support assemblies that would be comprised of soft material without the use of complex mechanical components, and that would be simple and practical, and that would not be bulky.

BRIEF SUMMARY OF THE INVENTION

One aspect of the present invention provides a filter assembly, comprising: a frame forming the outer perimeter of the filter assembly, the frame is comprised a first frame structure having one of a soft and firm material and a second frame structure having one of firm and soft material; a filter enclosed in between the first frame structure and the second frame structure; and a strap comprised of a second soft material that is coupled with the frame for detachably coupling the frame with a microphone.

One optional aspect of the present invention provides a filter assembly, wherein:

the first frame structure further includes a first extension that is integral with the first frame structure, forming a first single unitary piece frame casing; the second frame structure further includes a second extension that is integral with the second frame structure, forming a second single unitary piece frame casing; and wherein the first extension is aligned with the second extension to form a single pair.

Another optional aspect of the present invention provides a filter assembly, wherein: the first soft material is comprised of industry standard felt cloth.

Still another optional aspect of the present invention provides a filter assembly, wherein: the filter is comprised of one or more filter membranes.

A further optional aspect of the present invention provides a filter assembly, wherein the strap is further comprised of a first side that includes a first set of miniature clasps at a first distal end of the first side; a second side that includes a first set of miniature hooks at a second distal end of the second side; the strap having a middle section comprised of a closed loop; the closed loop is comprised of: an exterior, comprising: a first exterior side that is integrally coupled with the first side of the strap; and a second exterior side that is integrally coupled with the second side of the strap; an interior, comprising: a first interior side that includes a second set of miniature clasps; and a second interior side that includes a second set of miniature hooks; wherein the middle section of the strap is removably coupled with the first and second extension of the frame.

Still a further optional aspect of the present invention provides a filter assembly, wherein: the middle section of the strap is removably coupled with the first and the second extensions by pressing the second set of miniature clasps aligned along the first interior side against the second set of miniature hooks aligned along the second interior side.

Another optional aspect of the present invention provides a filter assembly, wherein: the strap detachably couples the frame with a microphone by enfolding the strap around the microphone, and pressing the first set of miniature clasps at the first distal end of the first side of the strap against the first set of miniature hooks at the second distal end of the second side.

Yet another optional aspect of the present invention provides a filter assembly, wherein: the strap is further comprised of: a first side that includes miniature clasps at a first distal end; a second side that includes miniature hooks at a second distal end; and wherein the second distal end of the strap is coupled with the first and the second extension of the frame.

Still another optional aspect of the present invention provides a filter assembly, wherein: the strap detachably couples the frame with a microphone by enfolding the strap around the microphone, and pressing the miniature clasps at the first distal end of the first side of the strap against the miniature hooks at the second distal end of the second side.

A further optional aspect of the present invention provides a filter assembly, wherein: the filter assembly is a side-address microphone filter assembly.

Yet a further optional aspect of the present invention provides a filter assembly, wherein: the first frame structure further includes a third extension at an opposite side from the first extension, and is integral with the first frame structure, forming the first single unitary piece frame casing; the second frame structure further includes a fourth extension at an opposite side from the second extension, and is integral with the second frame structure, forming the second single unitary piece frame casing; and wherein the first extension is aligned with the second extension to form a first single extension pair, and the third extension is aligned with the fourth extension to form a second extension pair.

Still a further optional aspect of the present invention provides a filter assembly, wherein: the middle section of the strap is removably coupled with one of the first single extension pair and the second single extension pair by pressing the second set of miniature clasps aligned along the first interior side against the second set of miniature hooks aligned along the second interior side.

Another optional aspect of the present invention provides a filter assembly, wherein: the strap detachably couples the frame with a microphone by enfolding the strap around the microphone, and pressing the first set of miniature clasps at the first distal end of the first side of the strap against the first set of miniature hooks at the second distal end of the second side.

Yet another optional aspect of the present invention provides a filter assembly, wherein: the filter assembly is a front-address microphone filter assembly.

Another aspect of the present invention provides a filter assembly, comprising: a frame comprised of a first soft material that forms the outer perimeter of the filter assembly, the frame comprising: a first frame structure that includes a first extension that is integral with the first frame structure, forming a first single unitary piece frame casing; a second frame structure that includes a second extension that is integral with the second frame structure, forming a second single unitary piece frame casing; a spacer unit that includes a third extension that is integral with the spacer unit, forming a single piece spacer, positioned in between the first frame casing and the second frame casing; a first filter membrane enclosed in between the first frame casing and a first side of the spacer unit; a second filter membrane enclosed in between the second frame casing and the second side of the spacer unit; and a strap comprised of a second soft material that is coupled with the frame for detachably coupling the frame with a microphone.

Still a further optional aspect of the present invention provides a filter assembly, wherein: the first frame structure, the second frame structure, and the spacer unit have substantially identical shapes.

Another optional aspect of the present invention provides a filter assembly, wherein: the spacer unit is of sufficient thickness to allow sufficient air gap between the first filter membrane and the second filter membrane.

Still a further optional aspect of the present invention provides a filter assembly, wherein: the strap is further comprised of: a first side that includes a first set of miniature clasps at a first distal end of the first side; a second side that includes a first set of miniature hooks at a second distal end of the second side; the strap having a middle section comprised of a closed loop; the closed loop is comprised of: an exterior, comprising: a first exterior side that is integrally coupled with the first side of the strap; and a second exterior side that is integrally coupled with the second side of the strap; an interior, comprising: a first interior side that includes a second set of miniature clasps; and a second interior side that includes a second set of miniature hooks; wherein the middle section of the strap is removably coupled with the first, second, and third extension of the frame.

Another optional aspect of the present invention provides a filter assembly, wherein: the middle section of the strap is removably coupled with the first, the second, and the third extension of the frame by pressing the second set of miniature clasps aligned along the first interior side against the second set of miniature hooks aligned along the second interior side.

Still a further optional aspect of the present invention provides a filter assembly, wherein: the strap detachably couples the frame with a microphone by enfolding the strap around the microphone, and pressing the first set of miniature clasps at the first distal end of the first side of the strap against the first set of miniature hooks at the second distal end of the second side.

Another optional aspect of the present invention provides a filter assembly, wherein: the strap is further comprised of: a first side that includes miniature clasps at a first distal end; a second side that includes miniature hooks at a second distal end; and wherein the second distal end of the strap is coupled with the third extension of the frame.

Still another optional aspect of the present invention provides a filter assembly, wherein: the strap detachably couples the frame with a microphone by enfolding the strap around the microphone, and pressing the miniature clasps at the first distal end of the first side of the strap against the miniature hooks at the second distal end of the second side.

These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character (s) present corresponding parts throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

The present invention provides a filter assembly that may be used more or less universally with various types of side-address and front-address microphones. The filter assembly of the present invention is comprised of a combination of a soft material and light weight (non-abrasive) firm material and is simple and practical to manufacture and use, and is not bulky nor does it use complex mechanical components for assembly and connections. The use of soft material for the filter assembly of the present invention prevents it from scratching or otherwise damaging the microphone and, further, prevents vibration and sound reflections. In other words, unlike the prior art rigid material where sound may vibrate the filter assembly and be reflected therefrom, the use of soft material reduces vibration of the filter assembly, and prevents sound from being reflected. In addition, given the soft material, the vibration of the filter assembly (if any) caused by the sound being recorded will most likely have very negligible effect (if any) on the final recording. Of course, the soft material used allows the filter assembly of the present invention to be coupled directly with a microphone for better recording, while not scratching it. The use of lightweight, non-abrasive firm material, non-limiting example of which may be a pressboard, placard, plastics, aluminum, cork, fiberglass and so on provides the skeletal support for the filter assembly without much added weight, complexity, or abrasiveness. The present invention provides a smaller filter assembly, which in many ways is improved because the smaller filter compels users to focus the sound of their recording on to a target area proximal the actual microphone capsule, providing a steady level of recorded sound. In other words, the small size design of the filter assembly of the present invention closely mimics the actual dimension of the microphone grill, and hence, a user will be compelled to be more focused to a smaller target area during recording, resulting in a superior recoding session. In addition to the above, the present invention further provides a soft strap to couple the frame with a microphone, which is not bulky, and does not use complex mechanical components for assembly and connections.

Figure 1A:
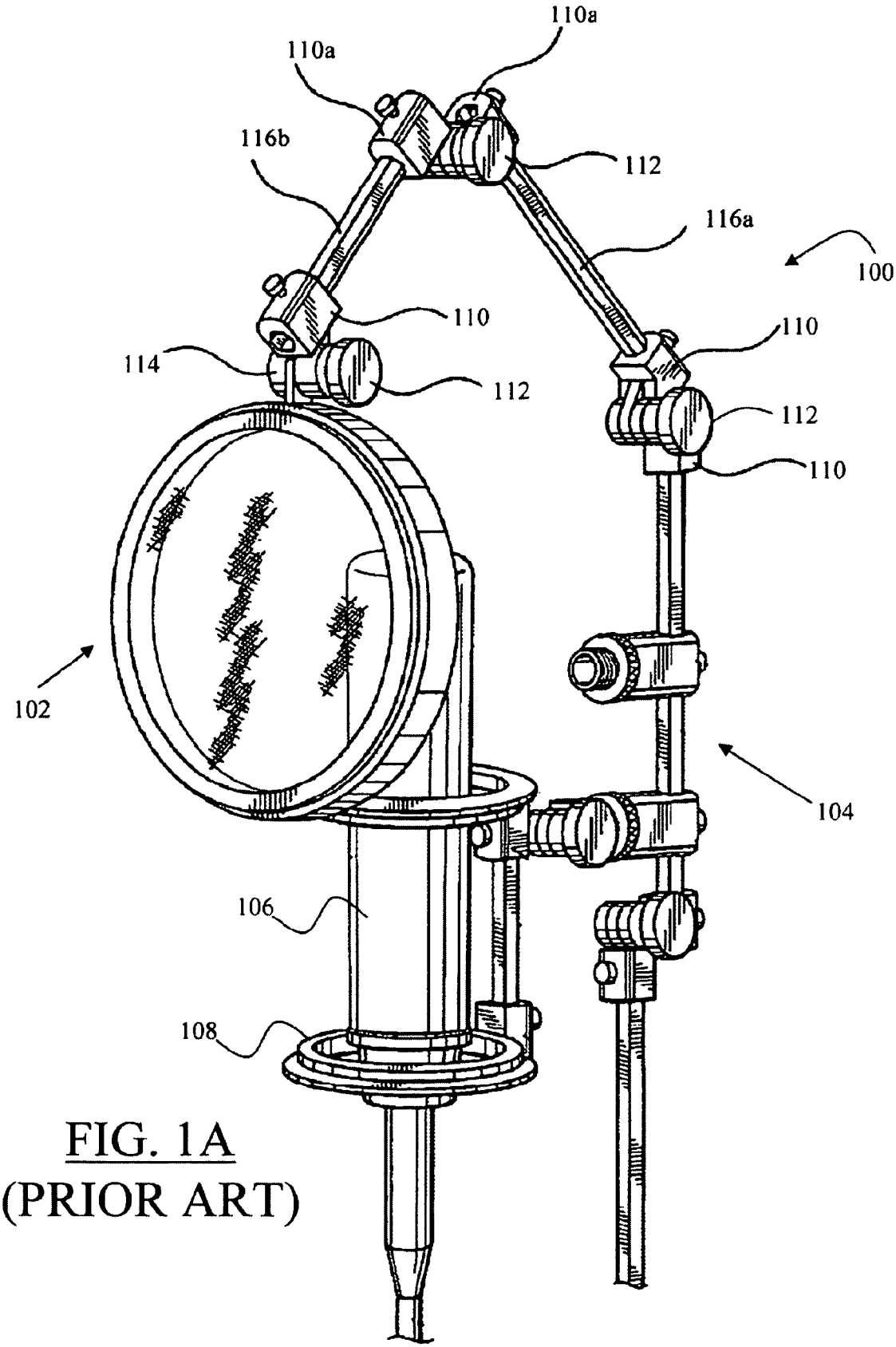
FIG. 1A (PRIOR ART)
FIG. 1A is an exemplary perspective view illustration of a prior art filter assembly and filter mounting assembly.
Figure 1C:
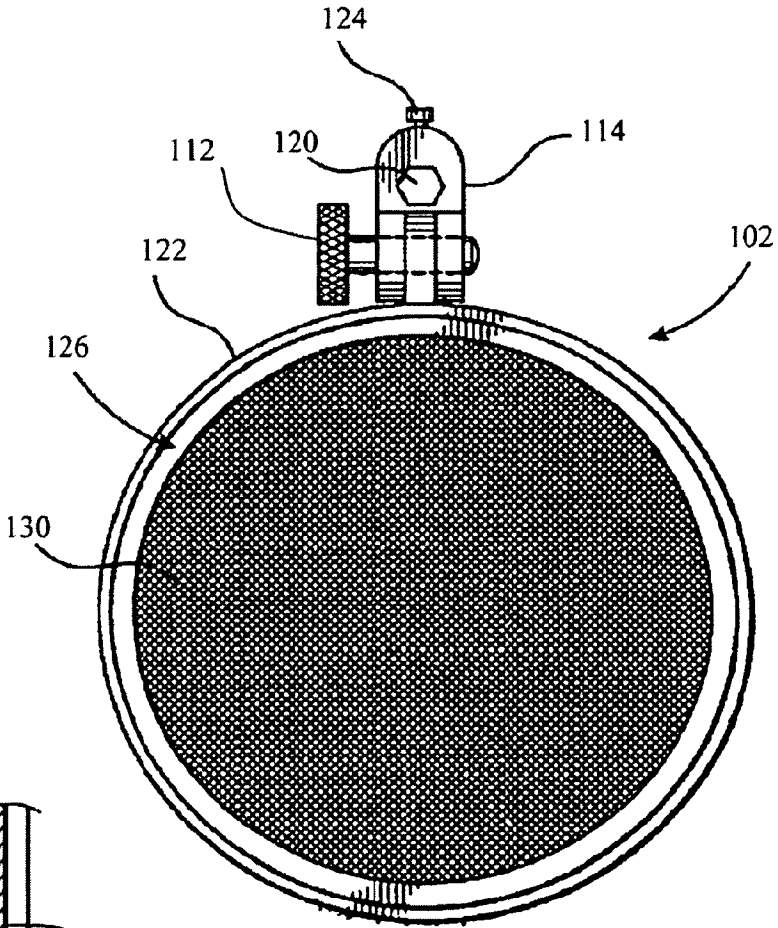
FIG. 1C (PRIOR ART)
FIG. 1C is an exemplary front view illustration of the prior art filter assembly illustrated in FIG. 1B.
Figure 1D:
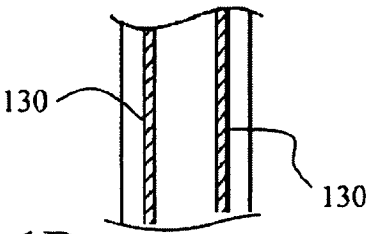
FIG. 1D (PRIOR ART)
FIG. 1D is an exemplary illustration, showing longitudinal sectional view of the prior art filter assembly illustrated in FIG. 1C.
Figure 1B:
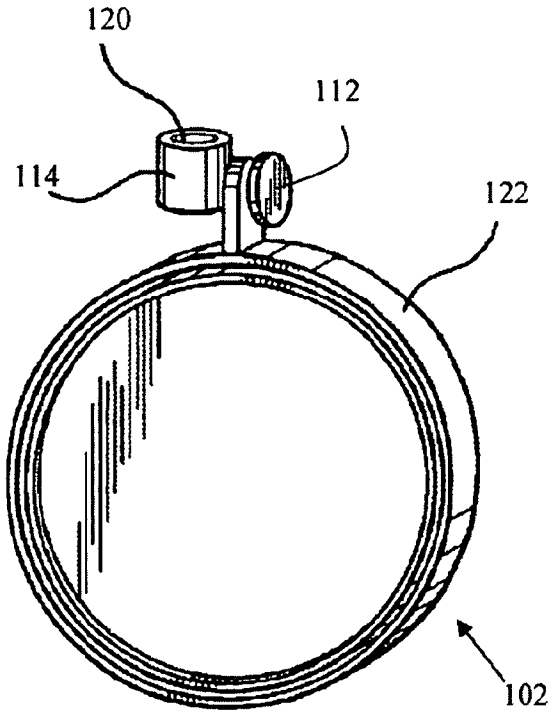
FIG. 1B (PRIOR ART)
FIG. 1B is an exemplary perspective view illustration of a prior art filter assembly.
Figure 2B:
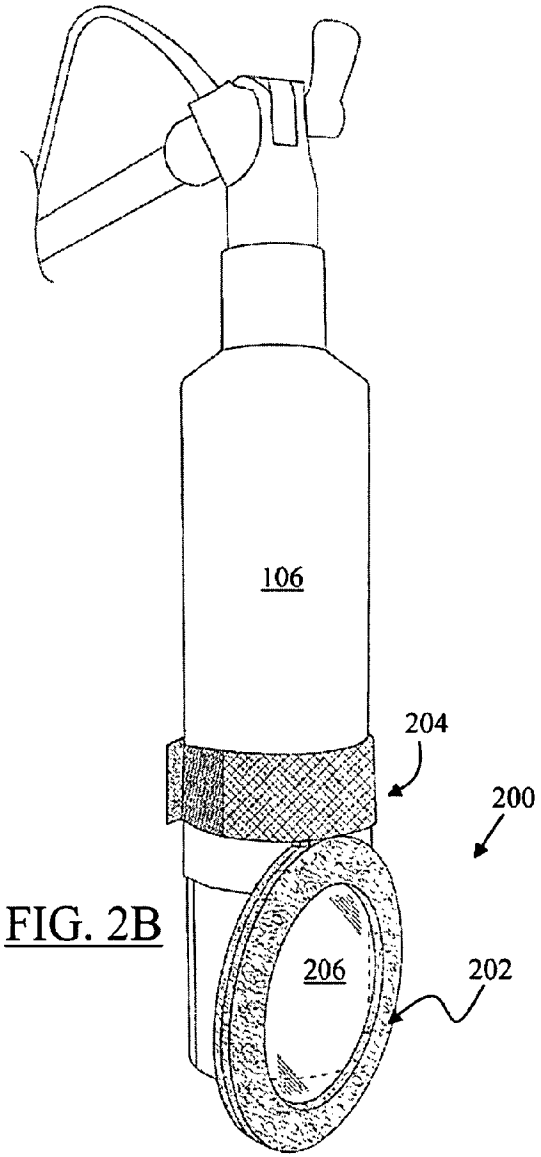
FIGS. 2A and 2B are exemplary illustrations of a filter assembly used with a side-address microphone in accordance with the present invention.
Figure 2A:
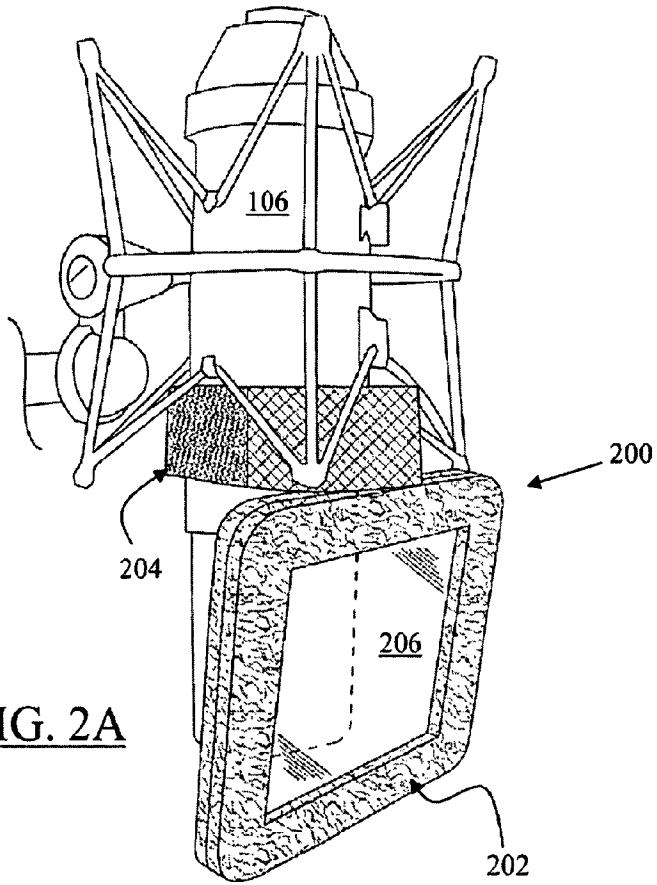

FIGS. 2A and 2B are exemplary perspective view illustration of a filter assembly 200 in accordance with the present invention, which illustrate the filter assembly 200 as coupled with exemplary side-address microphones using a soft strap. As illustrated in FIGS. 2A and 2B, the filter assembly 200 of the present invention is comprised of a frame 202 made up of first soft and flexible material layer, and a lightweight, non-abrasive firm material layer and is coupled with a strap 204, with the frame 202 encompassing a filter diaphragm 206. The strap 204 is comprised of a second soft material that is coupled with the frame 202 for detachably coupling the frame 202 with a microphone 106. In other words, the strap 204 couples the frame 202 with the microphone in a simple manner, replacing the conventional complex mechanical contraptions. In general, the side of the frame 202 proximate the microphone 106 is preferably comprised of the soft and flexible material layer, and the second side (away from the microphone 106) may comprise of either the soft flexible material or the lightweight, non-abrasive firm material. In other words, the frame 202 must be constructed of three pieces, including a soft flexible material, a lightweight, non-abrasive firm material, and a diaphragm, all of which are coupled with the strap 204.

As shown throughout the figures, the shape of the filter assembly may be varied, and should not to be limited to the illustrated four sided (FIG. 2A) or circular (FIG. 2B) forms. In particular, non-limiting examples for the various forms or configurations for the frame 202 may include any polygons, or any shape, including the shape of an emblem, symbol, or logo, for example, a logo that represents a company. For example, a star shaped frame 202 may be used for a recording studio company with a logo of a star, with a name "star recordings." However, regardless of the form or shape of the frame, the actual filter diaphragm 206 encompassed by the frame 202 (and hence the frame 202 itself) should be of sufficient size to provide full covering of the microphone grill with which it is coupled so to filter pop noise. This would compel the users to focus the sound of their recording on to a target area, proximal the actual microphone capsule, providing a steady level of recorded sound.

Figure 3B:
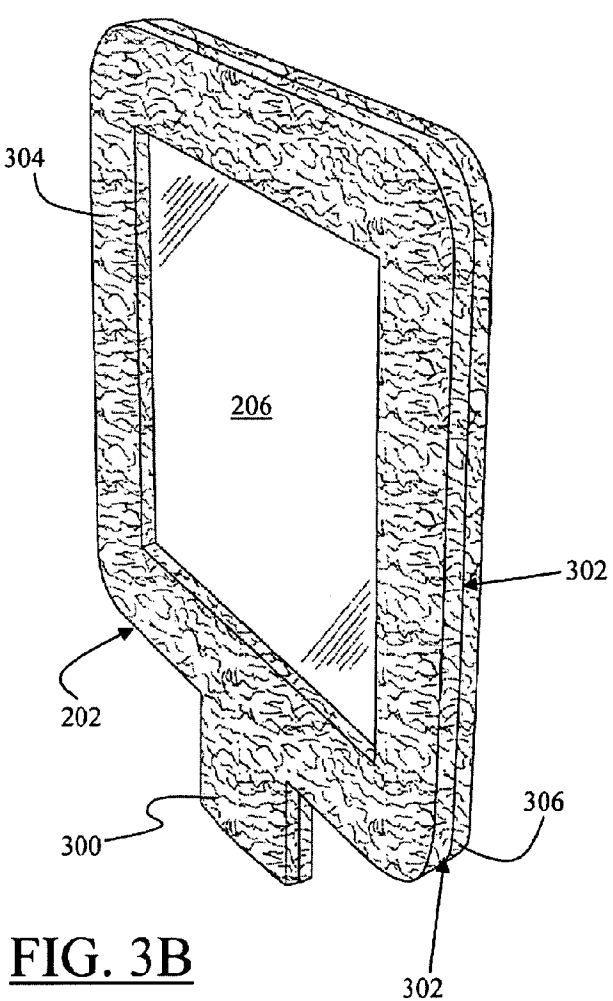
FIG. 3B is an exemplary enlarged illustration of a frame of the filter assembly illustrated in FIG. 3A in accordance with the present invention.
Figure 3A:
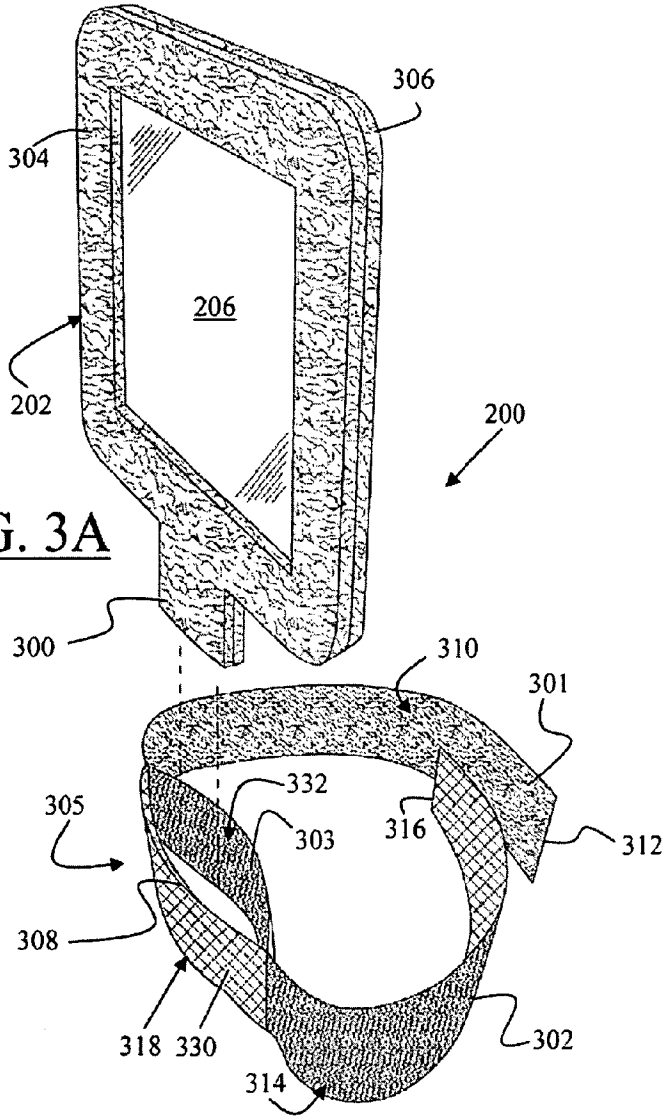
FIG. 3A is an exemplary illustration of a disassembled filter assembly in accordance with the present invention.

FIG. 3A is an exemplary illustration of a disassembled filter assembly 200 in accordance with the present invention, and FIG. 3B is an exemplary enlarged illustration of a frame of the filter assembly 200 illustrated in FIG. 3A. As illustrated, the complete filter assembly 200 is comprised of a frame 202 (including filter 206) and a strap 305, with the strap 305 used for coupling the frame 202 directly with a microphone 106. The frame 202 is comprised of a first soft material, a non-limiting example of which may preferably include industry standard felt cloth. Additionally, the frame 202 also includes a lightweight, non-abrasive firm material layer, non-limiting example of which may include a pressboard, placard, plastics, aluminum, cork, fiberglass and so on to provide the skeletal support for the filter assembly. The frame 202 forms the outer perimeter of the filter assembly 200, and comprises a first frame structure 304 and a second frame structure 306 coupled to one another 302. The filter assembly 200 is further comprised of a filter diaphragm 206 enclosed in between the first frame structure 304 and the second frame structure 306. As further illustrated, the filter assembly 200 includes a Velcro® type strap 305 that is comprised of a second soft material (preferably nylon) that couples with the frame 202 for detachably coupling the frame 202 with a microphone 106. The lightweight, non-abrasive firm material may be sandwiched in between the first frame structure 304 and the second frame structure 306, as a third layer. Further, one of the frame structures 304 or 306 may be comprised of the lightweight, non-abrasive firm material instead, making the illustrated frame 202 a three piece, rather than a four-piece frame. For example, the first frame structure 304 may comprise of a soft material and the second frame structure 306 constructed from the lightweight firm material, with a diaphragm 206 in between the two frame structures 304 and 306, and a strap 305 coupled thereto.

The strap 305 illustrated in FIG. 3A is comprised of a first side 310 that includes a first set of miniature clasps 301 at a first distal end 312 of the first side 310, and a second side 314 that includes a first set of miniature hooks 302 at a second distal end 316 of the second side 314. The strap 305 further includes a middle section 318 comprised of a closed loop, with the closed loop having an exterior that includes a first exterior side 930 (illustrated in FIG. 9) that is integrally coupled with the first side 310 of the strap, and a second exterior side 330 that is integrally coupled with the second side 314 of the strap 305. The closed loop of the strap 305 further includes an interior section that is comprised of a first interior side 932 that includes a second set of miniature clasps 308, and a second interior side 332 that includes a second set of miniature hooks 303. The closed loop forming the middle section 318 of the strap 305 is removably coupled with the extension 300 of the frame 202, by pressing the second set of miniature clasps 308 aligned along the first interior side 932 against the second set of miniature hooks 303 aligned along the second interior side 332. The strap 305 detachably couples the frame 202 directly with a microphone 106 by enfolding or wrapping the strap 305 around the microphone 106, and pressing the first set of miniature clasps 301 at the first distal end 312 of the first side 310 of the strap 305 against the first set of miniature hooks 302 at the second distal end 316 of the second side 314.

Figure 4B:
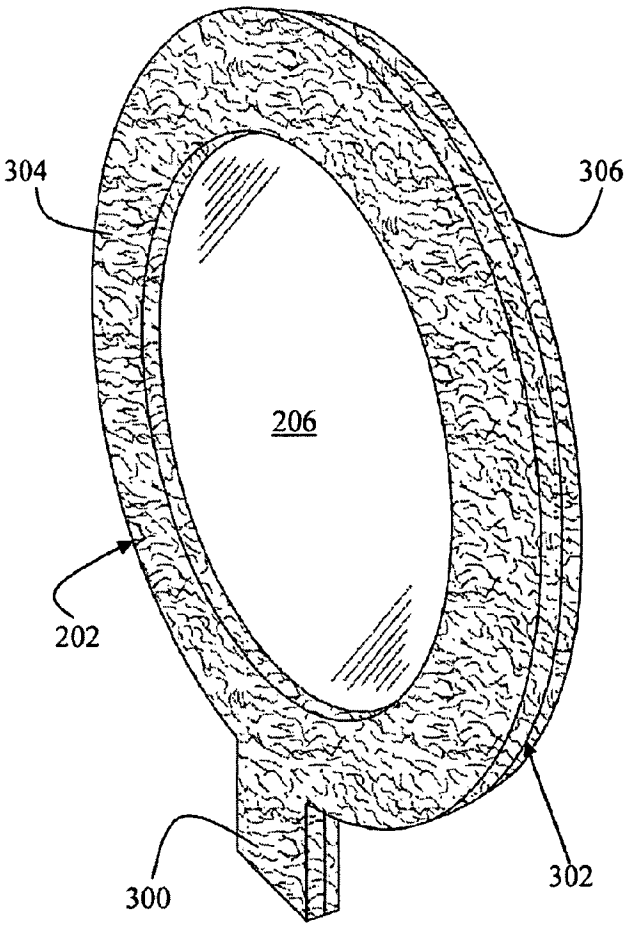
FIG. 4B is an exemplary enlarged illustration of a frame of the filter assembly illustrated in FIG. 4A in accordance with the present invention.
Figure 4A:
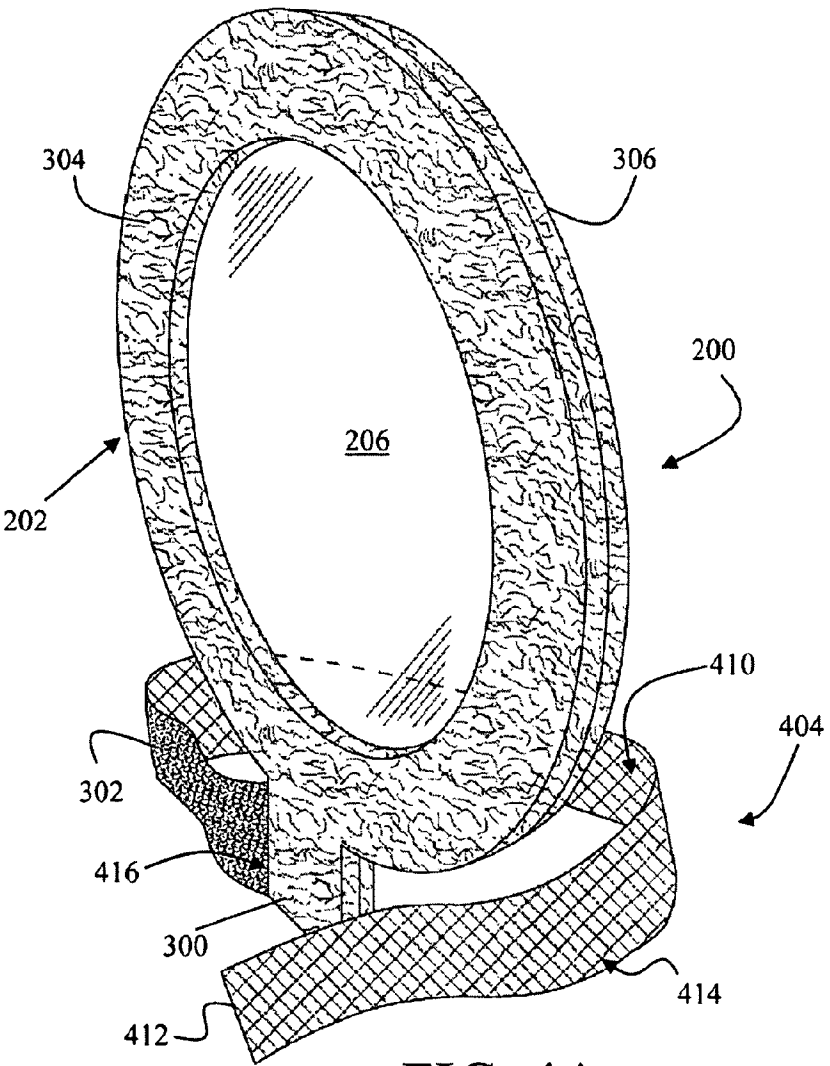
FIG. 4A is an exemplary illustration of a filter assembly using a permanently attached strap in accordance with the present invention.

FIG. 4A is an exemplary illustration of a filter assembly using a permanently attached strap in accordance with the present invention, and FIG. 4B is an exemplary enlarged illustration of a frame of the filter assembly illustrated in FIG. 4A. The filter assembly illustrated in FIGS. 4A and 4B includes similar corresponding or equivalent components as the filter assembly 200 that is shown in FIGS. 2A to 3B, and described above. Therefore, for the sake of brevity, clarity, convenience, and to avoid duplication, the general description of FIGS. 4A and 4B will not repeat every corresponding or equivalent component that has already been described above in relation to filter assembly 200 that is shown in FIGS. 2A to 3B.

As illustrated, the frame 202 of the filter assembly 200 includes a Velcro® type strap 404 permanently attached to the extension 300 of the frame 202. The connection of the strap 404 to the extension 300 is preferably between the first frame structure 304 and the second frame structure 306, but may be coupled with the exterior facing surfaces of the frame structure, exterior surface of either 304 or 306. The strap 404 is comprised of a first side 410 that includes miniature clasps 301 at a first distal end 412, and a second side 414 that includes miniature hooks 302 at a second distal end 416. As illustrated, the second distal end 416 of the strap 404 is coupled with the extension 300 of the frame 202, preferably between the frame structures 304 and 306. The strap 404 detachably couples the frame 202 directly with a microphone 106 by enfolding or wrapping the strap 404 around the microphone 106, and pressing the miniature clasps 301 at the first distal end 412 of the first side 410 of the strap 404 against the miniature hooks 302 at the second distal end 416 of the second side 414.

Figure 5B:
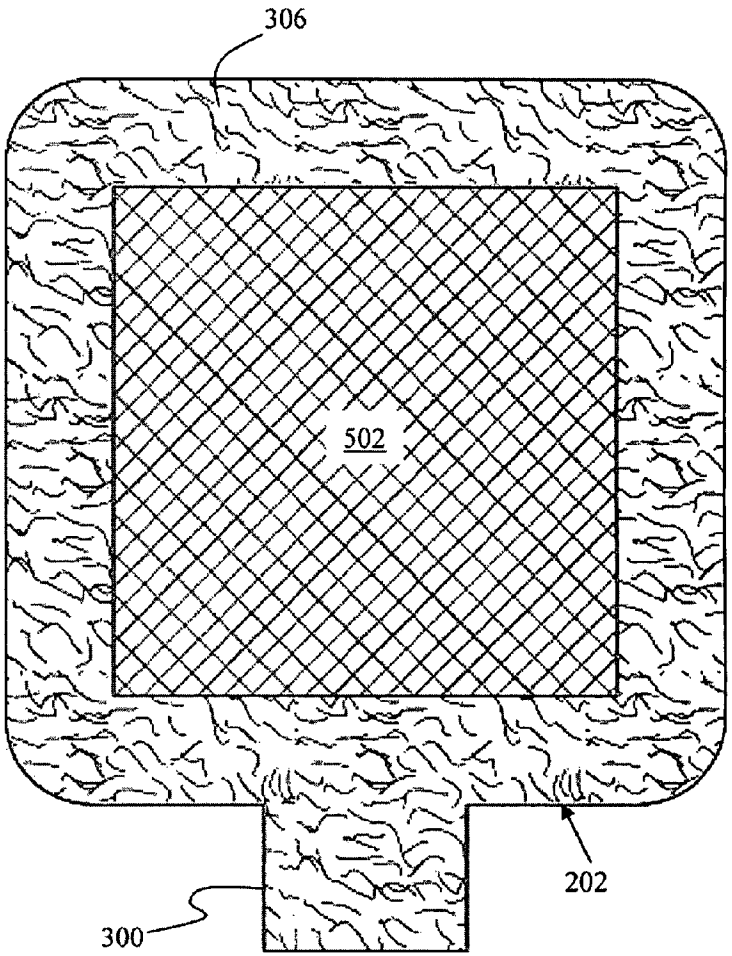
FIGS. 5A to 5D are exemplary enlarged illustrations of a frame for a filter assembly, using dual filter membranes in accordance with the present invention.
Figure 5A:
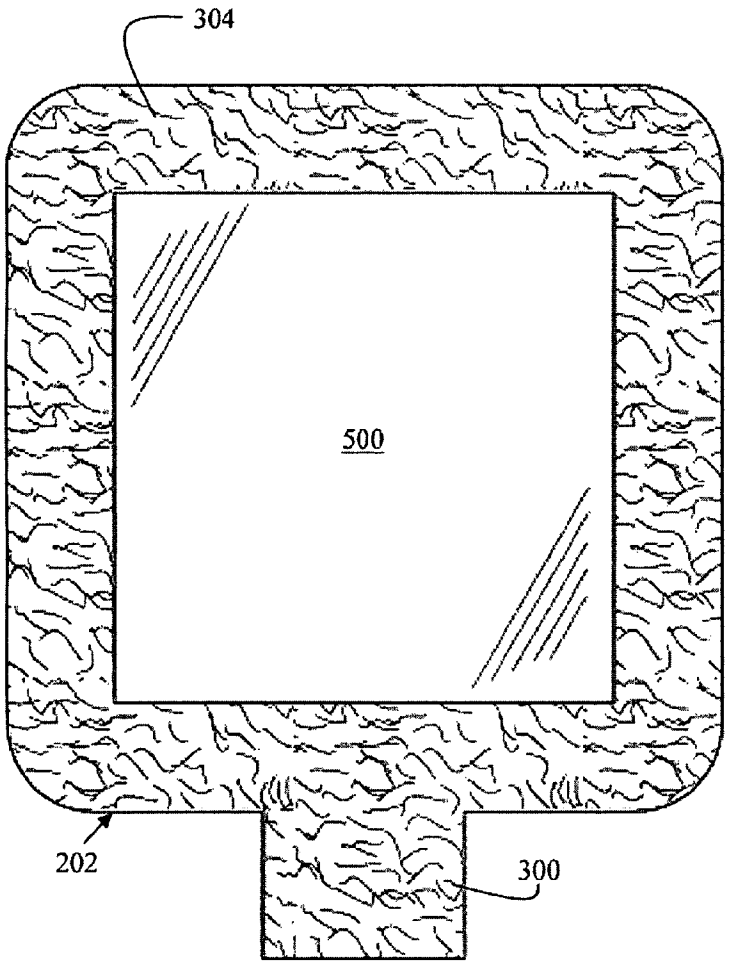
Figure 5D:
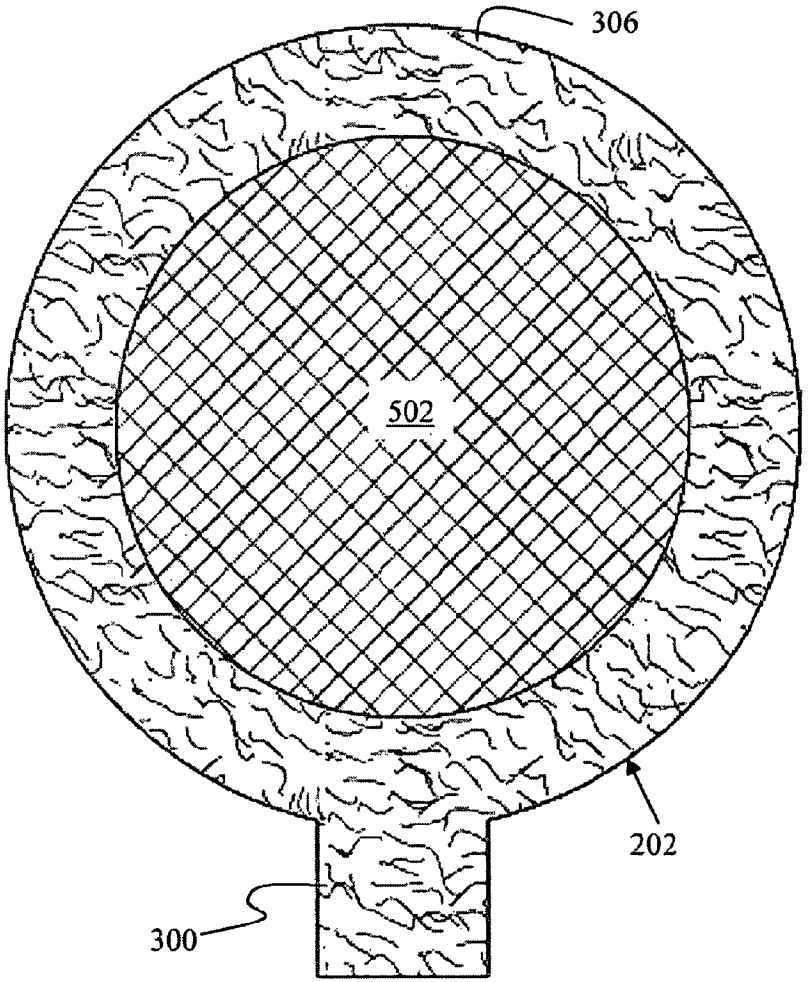
Figure 5C:
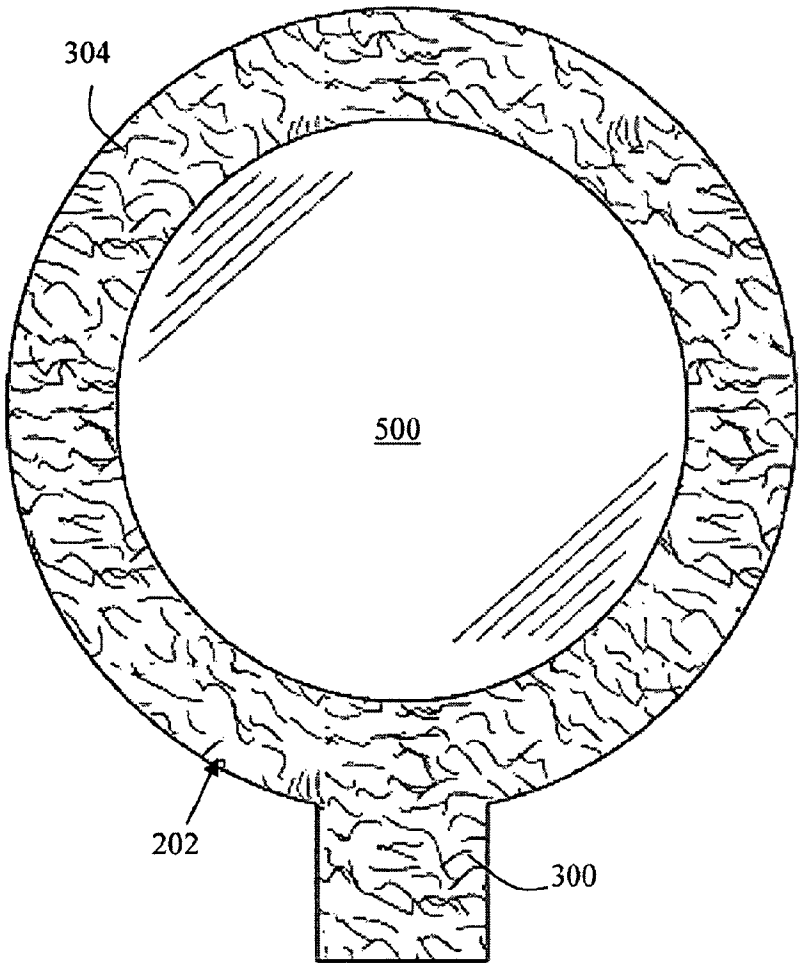

FIGS. 5A to 5D are exemplary enlarged illustrations of a frame 202 for a filter assembly, using filter diaphragm 206 that may optionally comprise of two or more filter membranes 500 and 502 in accordance with the present invention. As illustrated in FIGS. 5A and 5C, the first side of the frame 202 may include a first filter membrane 500, which is juxtaposed with a second filter membrane 502 on the second side of the frame 202 that is illustrated in FIGS. 5B and 5D. As illustrated, the first filter membrane 500 may be the same or different from the second filter membrane 502, providing a dual membrane filtering capability. Again, outer perimeter configuration of the frames 202 may be of any shape.

Figure 6:
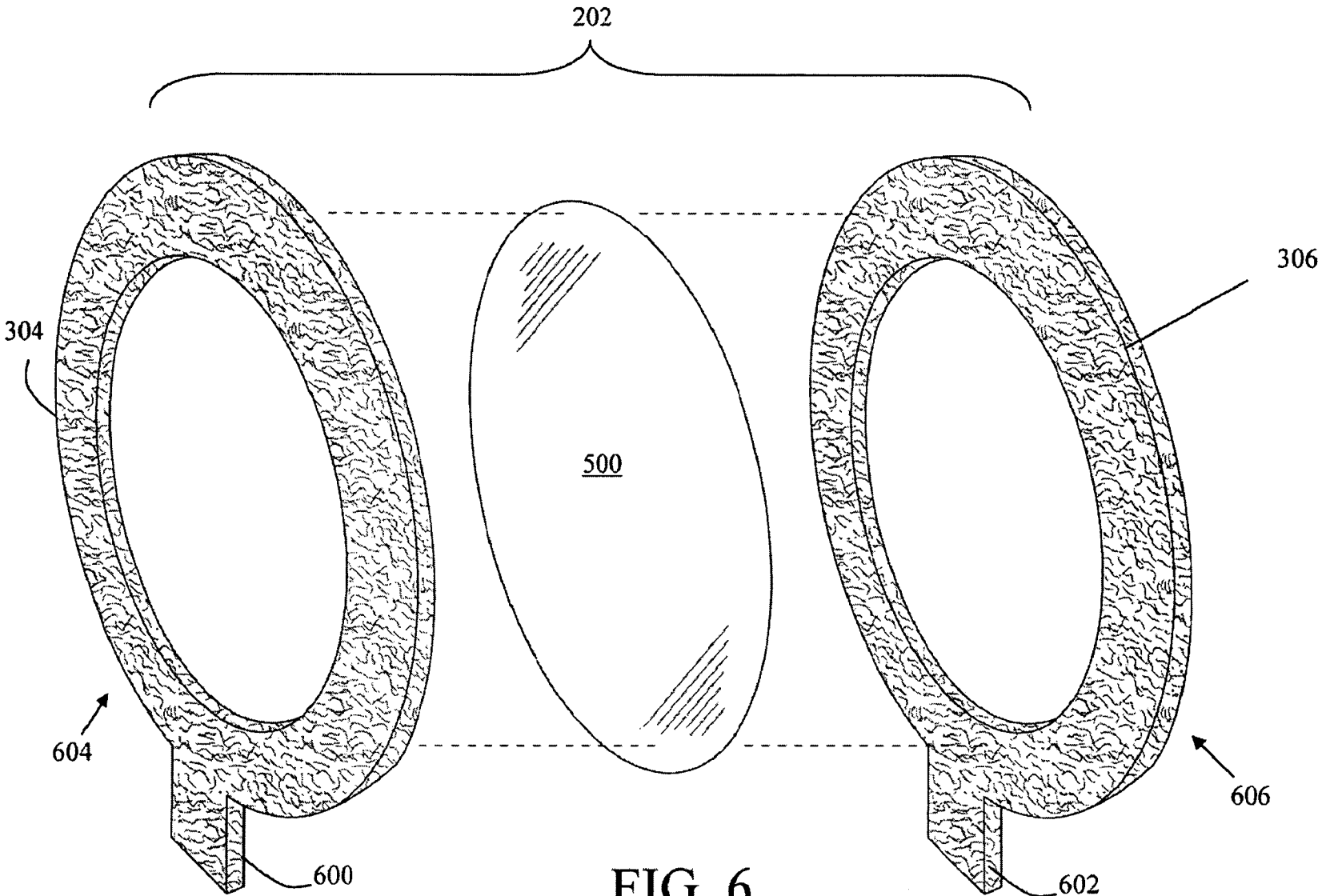
FIG. 6 is an exemplary illustration of a disassembled frame for a filter assembly that uses a single filter membrane, in accordance with the present invention.

FIG. 6 is an exemplary illustration of a disassembled frame 202 for a filter assembly that uses a single filter membrane 500 in accordance with the present invention. As illustrated, the frame 202 is comprised of a first single unitary piece frame casing 604 that is comprised of the first frame structure 304 that includes a first extension 600 that is integral with the first frame structure 304. The first frame structure 304 may comprise of a first soft material, a non-limiting example of which may preferably include industry standard felt cloth. Alternatively, the first frame structure 304 may comprise of a lightweight, non-abrasive firm material, non-limiting example of which may be a pressboard, placard, plastics, aluminum, cork, fiberglass and so on to provide the skeletal support for the filter assembly, without added weight, bulk, or complexity. In addition, the frame 202 is further comprised of a second single unitary piece frame casing 606 that is comprised of the second frame structure 306 that includes a second extension 602 that is integral with the second frame structure 306. The second frame structure 306 may comprise of a first soft material, a non-limiting example of which may preferably include industry standard felt cloth. Alternatively, the second frame structure 306 may comprise of a lightweight, non-abrasive firm material, non-limiting example of which may be a pressboard, placard, plastics, aluminum, cork, fiberglass and so on to provide the skeletal support for the filter assembly, without added weight, bulk, or complexity. It should be noted that one or both frame structures may be comprised of firm material. The first extension 600 is aligned and coupled with the second extension 602 to form the previously illustrated single pair extension 300. As further illustrated, the filter 206 is comprised of a single filter membrane 500, which is juxtaposed in between the respective first and the second single unitary piece frame casings 604 and 606 to from the frame 202. A strap 204, in the form of either strap 305 or 404 is then coupled with the frame 202 to couple the filter assembly 200 with a microphone 106.

Figure 7:
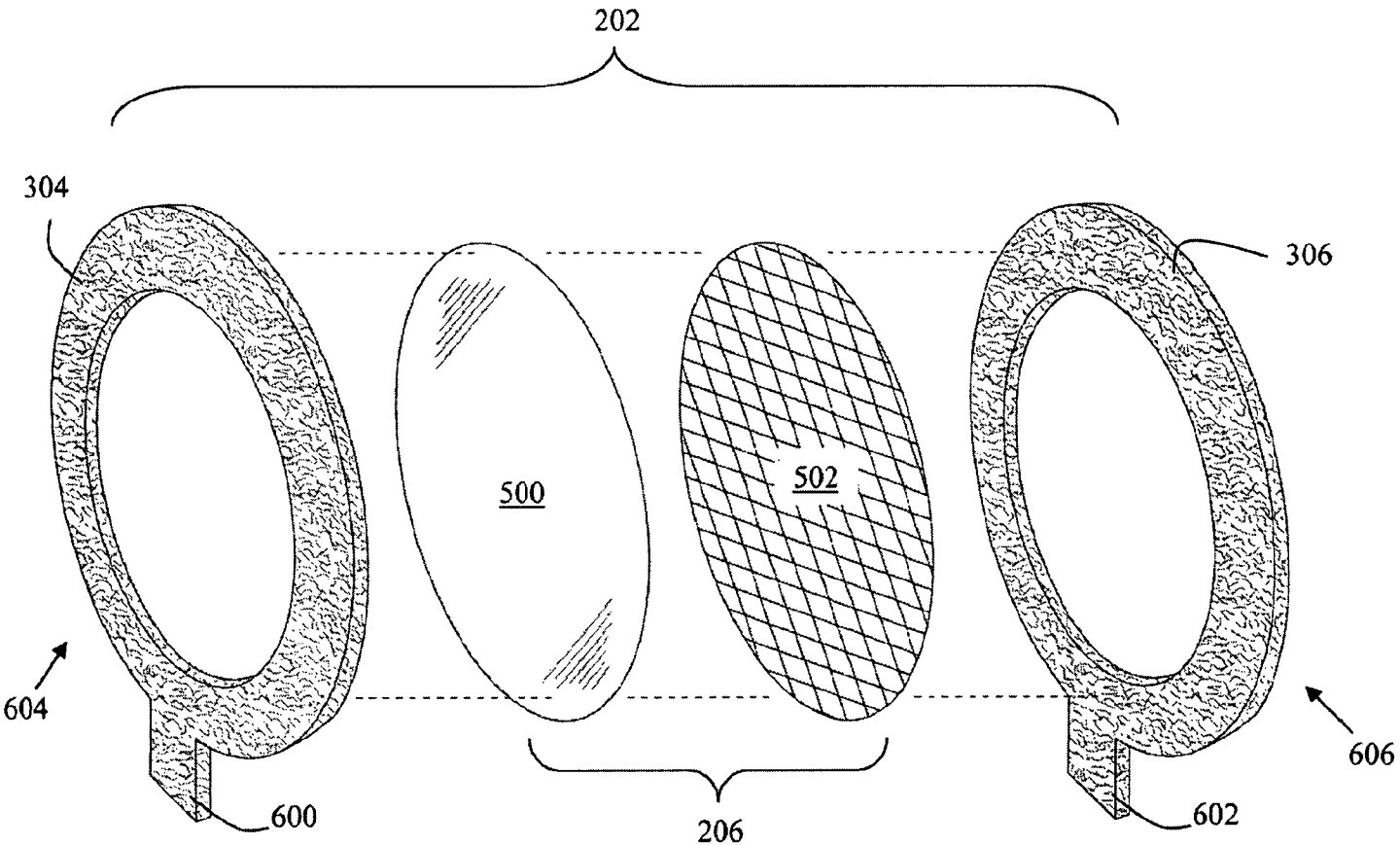
FIG. 7 is an exemplary illustration of a disassembled frame for a filter assembly that uses (Val filter membranes, in accordance with the present invention.

FIG. 7 is an exemplary illustration of a disassembled frame 202 for a filter assembly that uses dual filter membranes 500 and 502 in accordance with the present invention. As illustrated, the frame 202 is similar to that of FIG. 6 and is comprised of the first single unitary piece frame casing 604 that is comprised of the first frame structure 304 that includes a first extension 600 that is integral with the first frame structure 304. In addition, the frame 202 is further comprised of the second single unitary piece frame casing 606 that is comprised of the second frame structure 306 that includes a second extension 602 that is integral with the second frame structure 306, with the first extension 600 aligned and coupled with the second extension 602 to form the single pair extension 300. As further illustrated, the filter diaphragm 206 is comprised of two filter membranes 500 and 502, which are juxtaposed next to one another and in between the respective first and the second single unitary piece frame casings 604 and 606 to from the frame 202, providing dual filtering capability. A strap 204, in the form of either strap 305 or 404 is then coupled with the frame 202 to couple the filter assembly 200 with a microphone 106.

Figure 8B:
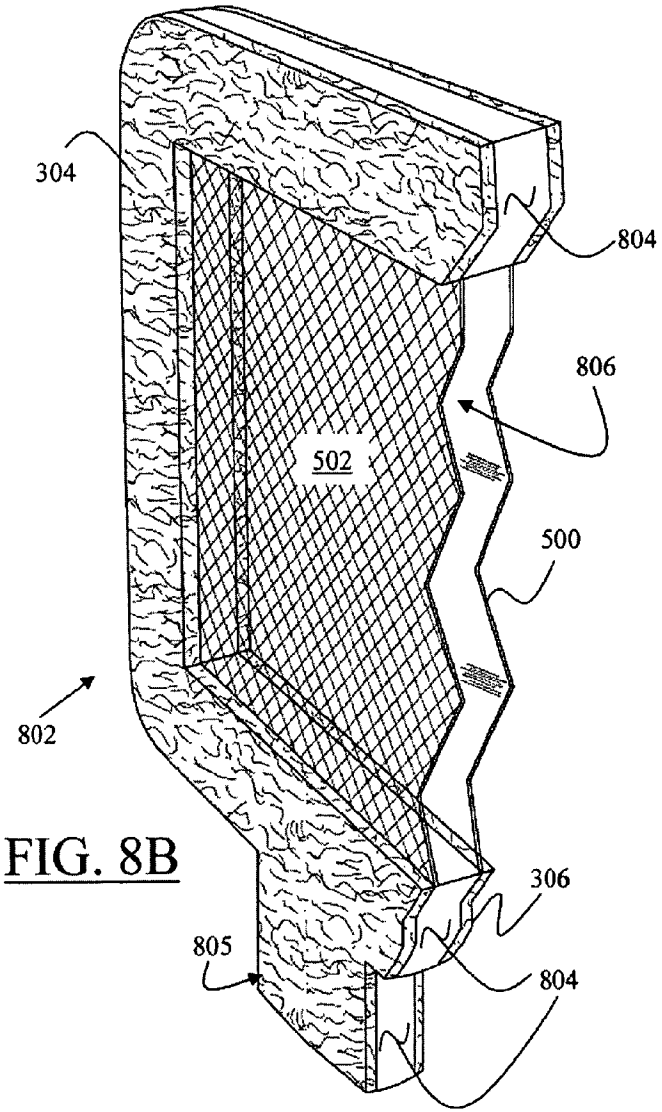
FIGS. 8A and 8B are exemplary illustrations of another embodiment for a frame for a filter assembly used with a side-address microphone in accordance with the present invention.
Figure 8A:
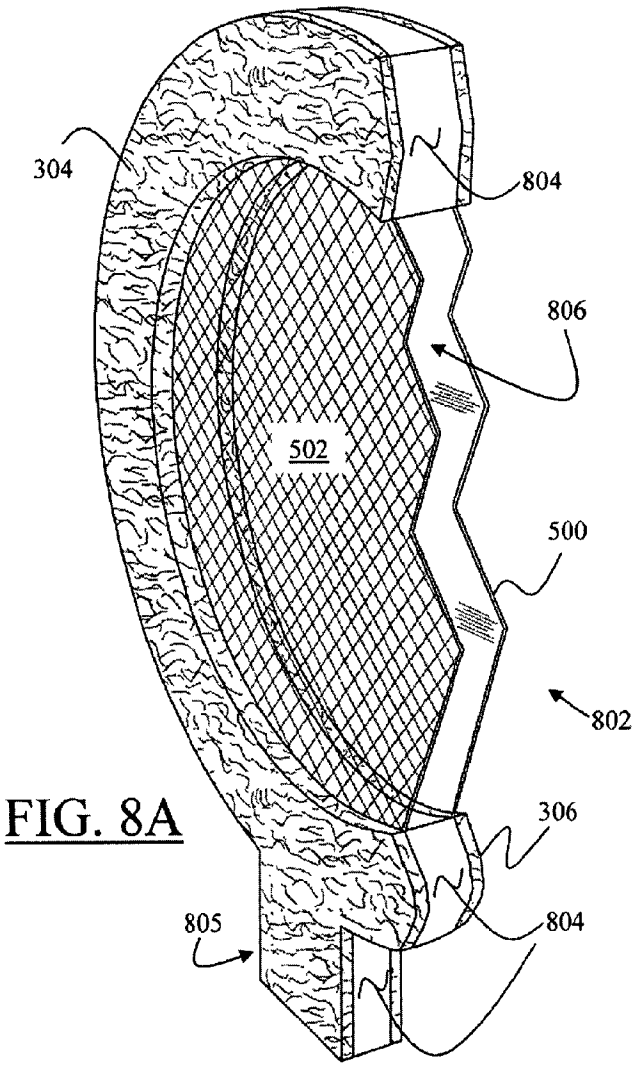
Figure 8C:
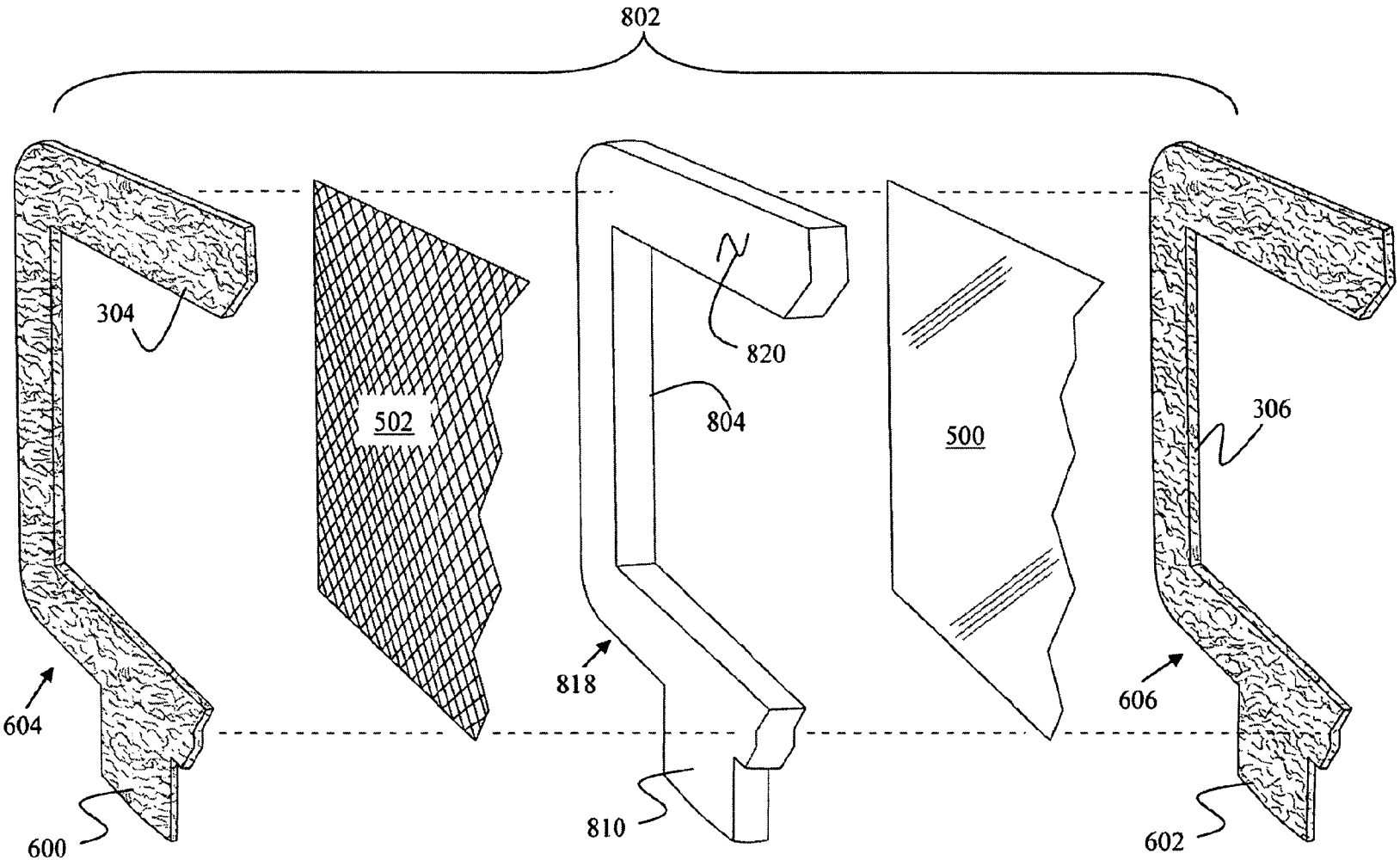
FIG. 8C is an exemplary illustration of a disassembled frame for the filter assembly illustrated in FIG. 8B in accordance with the present invention.

FIGS. 8A and 8B are exemplary illustrations of another embodiment for a frame 802 for a filter assembly that use a spacer in between two filter membranes, with the filter assembly used with a side-address microphone in accordance with the present invention, and FIG. 8C is an exemplary illustration of the disassembled frame 802 illustrated in FIGS. 8A and 8B. The frame 802 includes similar corresponding or equivalent components as the frame 202 that is shown in FIGS. 2A to 7, and described above. Therefore, for the sake of brevity, clarity, convenience, and to avoid duplication, the general description of FIGS. 8A to 8C will not repeat every corresponding or equivalent component that has already been described above in relation to frame 202 that is shown in FIGS. 2A to 7.

With the frame 802 of the present invention, a spacer unit 804 is provided that includes a third extension 810 that is integral with the spacer unit 804, forming a single piece spacer 818, positioned in between the first frame casing 604 and the second frame casing 606. The respective optional first and second extensions 600 and 602, and the third extension 810 collectively form the extension 805 of the frame 802.

The filter diaphragm 206 used with frame 802 includes a second filter membrane 502 enclosed in between the first frame casing 604 and a first side 820 of the single piece spacer 818. The first filter membrane 500 is enclosed in between the second frame casing 606 and a second side (mirror image of the first side 820) of the single piece spacer 818. As best illustrated in FIG. 8C, the first frame structure 304, the second frame structure 306, and the spacer unit 804 have substantially identical shape. In general, the spacer unit 804 is of sufficient thickness to allow sufficient air gap 806 between the first filter membrane 500 and the second filter membrane 502. A strap (305 or 404) comprised of a second soft material couples with the frame 802 for detachably coupling the frame 802 directly with a microphone 106.

Using strap 305 with the alternative embodiment illustrated in FIGS. 8A to 8C, the middle section 318 of the strap 305 is removably coupled with the collective extension 805 of the frame 802, in identical manner described above in relation to frame 202. That is, the middle section 318 of the strap 305 is removably coupled with the collective extension 805 of the frame 802 by pressing the second set of miniature clasps 308 aligned along the first interior side against the second set of miniature hooks 303 aligned along the second interior side. The strap 204 detachably couples the frame 802 directly with a microphone 106 by enfolding or wrapping the strap 305 around the microphone 106, and pressing the first set of miniature clasps 301 at the first distal end 312 of the first side 310 of the strap 305 against the first set of miniature hooks 302 at the second distal end 316 of the second side 314.

Using strap 404 with the embodiment illustrated in FIGS. 8A to 8C, the strap 404 may be permanently attached to the collective extension 805 of the frame 802 by the preferred connection of its second distal end 416 to the third extension 810 of the space piece 818. The strap 404 may then be used to detachably couple the frame 802 directly with a microphone 106 by enfolding or wrapping the strap 404 around the microphone 106, and pressing the miniature clasps 301 at the first distal end 412 of the first side 410 of the strap 404 against the miniature hooks 302 at the second distal end 416 of the second side 414.

Figure 9A:
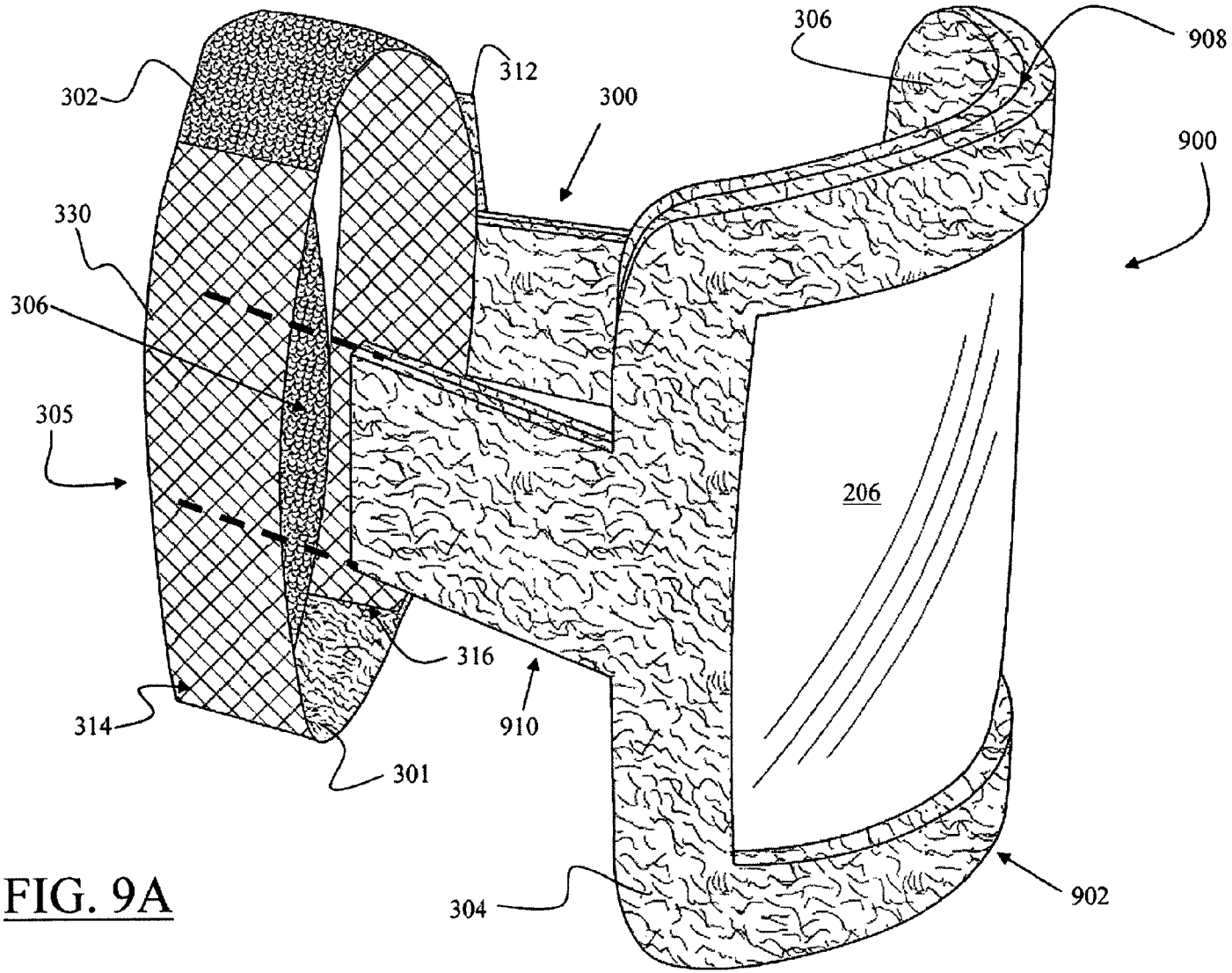
FIGS. 9A and 9B are exemplary illustrations of a filter assembly used with a front-address microphone in accordance with the present invention.
Figure 9B:
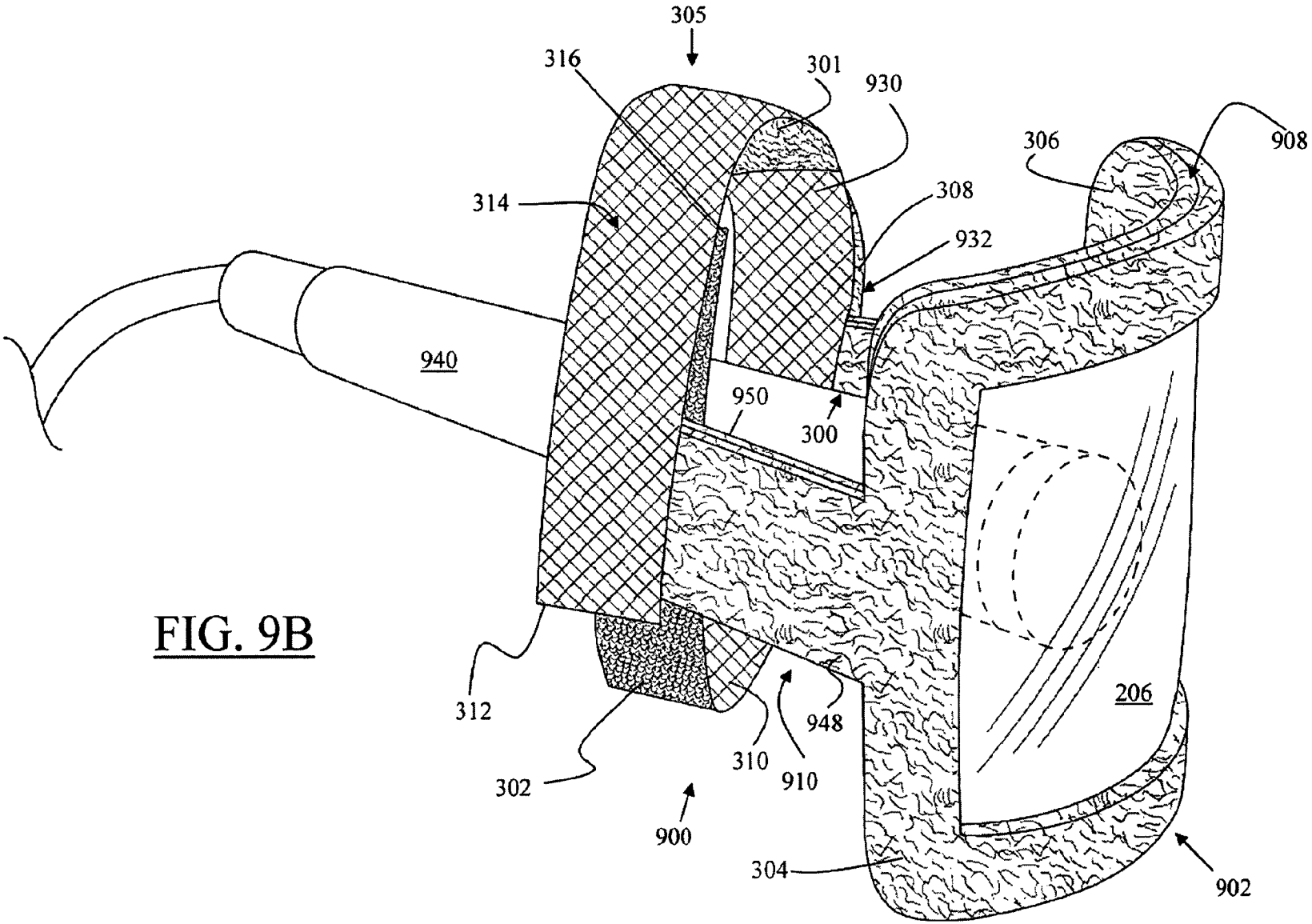

FIGS. 9A and 9B are exemplary illustrations of a filter assembly 900 used with a front-address microphone 940 (FIG. 9B) in accordance with the present invention. The filter assembly 900 in both FIGS. 9A and 9B is identical. FIG. 9A illustrates the filter assembly 900 without the microphone 240, and a first orientation (position) of the strap 305, whereas FIG. 9B illustrates the same filter assembly 900 with a microphone 240, and the second orientation (rotated position) of the same strap 305 to better illustrate the strap 305. The filter assembly 900 includes similar corresponding or equivalent components as the filter assembly 200 that is shown in FIGS. 2A to 8C, and described above. Therefore, for the sake of brevity, clarity, convenience, and to avoid duplication, the general description of FIGS. 9A and 9B will not repeat every corresponding or equivalent component that has already been described above in relation to filter assembly 200 that is shown in FIGS. 2A to 8C.

As illustrated in both FIGS. 9A and 9B, the filter assembly 900 of the present invention is used with front-address microphones 940, and includes a frame 902 that is comprised of a first frame structure 304 and a second frame structure 306. The frame 902 includes an extension 910 at an opposite side from the extension 300, with the extension 910 comprising of two sections (948 and 950) paired together, and integral with respective first frame structure 304 and the second frame structure 306. If strap 305 is used to couple the frame 902 directly with a microphone 940, then the middle section of the strap 305 is removably coupled with one of the first single extension pair 300 and the second single extension pair 910 by pressing the second set of miniature clasps 308 of the closed loop of the strap 305, which are aligned along the first interior side 932, against the second set of miniature hooks 306 aligned along the second interior side 332. The strap 305 detachably couples the frame 902 with a microphone 940 by enfolding the strap 305 around the microphone 940, and pressing the first set of miniature clasps 301 at the first distal end 312 of the first side 310 of the strap 305 against the first set of miniature hooks 302 at the second distal end 316 of the second side 314. Of course, it is possible to use strap 404 with the filter assembly 900, with the second distal end 416 of the strap 404 coupled with one of the extensions 910 or 300. In this case, the strap 404 detachably couples the frame 902 with a microphone 940 by enfolding the strap around the microphone, and pressing the miniature clasps 301 at the first distal end 412 of the first side 410 of the strap 404 against the miniature hooks 302 at the second distal end 416 of the second side 414.

The actual process of making the filter assembly is simple, and may be achieved by a variety of methods, including die-cut of the various components, and coupling of those components with one another by a variety of methods, a non-limiting example of which may include the use of glues or other adhesives, stitching, and so on.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Therefore, while exemplary illustrative embodiments of the invention have been described, numerous variations and alternative embodiments will occur to those skilled in the art. For example, instead of using felt material, soft neoprene rubber foam, or a combination of neoprene and similar material, may be used instead to construct the frames. The straps preferably use Velcro® as one form of fastening mechanism, however, other fastening mechanisms may also be used, non-limiting examples of which may include well-known clip-on or snap-on mechanisms. The non-limiting examples for clip-on or snap-on coupling mechanisms may include complementary or reciprocal male/female couplers, with the female coupler attached to one (e.g., to one side of the strap) and the male to the other (e.g., the other side of the strap). Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, proximal, distal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

What is claimed is:

1. A filter assembly, comprising:

a frame forming the outer perimeter of the filter assembly, the frame is comprised a first frame structure having one of a soft and firm material and a second frame structure having one of firm and soft material;

a filter enclosed in between the first frame structure and the second frame structure; and a strap comprised of a second soft material that is coupled with the frame for detachably coupling the frame with a microphone;

the first frame structure further includes a first extension that is integral with the first frame structure, forming a first single unitary piece frame casing;

the second frame structure further includes a second extension that is integral with the second frame structure, forming a second single unitary piece frame casing; and wherein the first extension is aligned with the second extension to form a single pair;

the strap is further comprised of:

a first side that includes a first set of miniature clasps at a first distal end of the first side;

a second side that includes a first set of miniature hooks at a second distal end of the second side;

the strap having a section comprised of a closed loop;

the closed loop is comprised of:

an exterior, comprising:

a first exterior side that is integrally coupled with the first side of the strap; and a second exterior side that is integrally coupled with the second side of the strap;

an interior, comprising:

a first interior side that includes a second set of miniature clasps; and a second interior side that includes a second set of miniature hooks;

wherein the section of the strap is removably coupled with the first and second extension of the frame.

2. The filter assembly as set forth in claim 1, wherein:

the first soft material is comprised of industry standard felt cloth.

3. The filter assembly as set forth in claim 1, wherein:

the filter is comprised of one or more filter membranes.

4. The filter assembly as set forth in claim 1, wherein:

the section of the strap is removably coupled with the first and the second extensions by pressing the second set of miniature clasps aligned along the first interior side against the second set of miniature hooks aligned along the second interior side.

5. The filter assembly as set forth in claim 1, wherein:

the strap detachably couples the frame with a microphone by enfolding the strap around the microphone, and pressing the first set of miniature clasps at the first distal end of the first side of the strap against the first set of miniature hooks at the second distal end of the second side.

6. The filter assembly as set forth in claim 1, wherein:

the filter assembly is a side-address microphone filter assembly.

7. The filter assembly as set forth in claim 1, wherein:

the first frame structure further includes a third extension at an opposite side from the first extension, and is integral with the first frame structure, forming the first single unitary piece frame casing;

the second frame structure further includes a fourth extension at an opposite side from the second extension, and is integral with the second frame structure, forming the second single unitary piece frame casing; and wherein the first extension is aligned with the second extension to form a first single extension pair, and the third extension is aligned with the fourth extension to form a second extension pair.

8. The filter assembly as set forth in claim 7, wherein:

the section of the strap is removably coupled with one of the first single extension pair and the second single extension pair by pressing the second set of miniature clasps aligned along the first interior side against the second set of miniature hooks aligned along the second interior side.

9. The filter assembly as set forth in claim 7, wherein:

the strap detachably couples the frame with a microphone by enfolding the strap around the microphone, and pressing the first set of miniature clasps at the first distal end of the first side of the strap against the first set of miniature hooks at the second distal end of the second side.

10. The filter assembly as set forth in claim 7, wherein:

the filter assembly is a front-address microphone filter assembly.

11. A filter assembly, comprising:

a frame that forms the outer perimeter of the filter assembly, the frame comprising:

a first frame structure that includes a first extension that is integral with the first frame structure, forming a first single unitary piece frame casing;

a second frame structure that includes a second extension that is integral with the second frame structure, forming a second single unitary piece frame casing;

a spacer unit that includes a third extension that is integral with the spacer unit, forming a single piece spacer, positioned in between the first frame casing and the second frame casing;

a first filter membrane enclosed in between the first frame casing and a first side of the spacer unit;

a second filter membrane enclosed in between the second frame casing and the second side of the spacer unit; and a strap comprised of a second soft material that is coupled with the frame for detachably coupling the frame with a microphone.

12. The filter assembly as set forth in claim 11, wherein:

the first frame structure, the second frame structure, and the spacer unit have substantially identical shapes.

13. The filter assembly as set forth in claim 11, wherein:

the spacer unit is of sufficient thickness to allow sufficient air gap between the first frame structure and the second frame structure.

14. The filter assembly as set forth in claim 11, wherein:

the first soft material is comprised of industry standard felt cloth.

15. The filter assembly as set forth in claim 11, wherein:

the strap is further comprised of:

a first side that includes a first set of miniature clasps at a first distal end of the first side;

a second side that includes a first set of miniature hooks at a second distal end of the second side;

the strap having a section comprised of a closed loop;

the closed loop is comprised of:

an exterior, comprising:

a first exterior side that is integrally coupled with the first side of the strap; and a second exterior side that is integrally coupled with the second side of the strap;

an interior, comprising:

a first interior side that includes a second set of miniature clasps; and a second interior side that includes a second set of miniature hooks;

wherein the section of the strap is removably coupled with the first, second, and third extension of the frame.

16. The filter assembly as set forth in claim 15, wherein:

the section of the strap is removably coupled with the first, the second, and the third extension of the frame by pressing the second set of miniature clasps aligned along the first interior side against the second set of miniature hooks aligned along the second interior side.

17. The filter assembly as set forth in claim 11, wherein:

the strap detachably couples the frame with a microphone by enfolding the strap around the microphone, and pressing the first set of miniature clasps at the first distal end of the first side of the strap against the first set of miniature hooks at the second distal end of the second side.

18. The filter assembly as set forth in claim 11, wherein:

the strap is further comprised of:

a first side that includes miniature clasps at a first distal end;

a second side that includes miniature hooks at a second distal end; and wherein the second distal end of the strap is coupled with the third extension of the frame.

19. The filter assembly as set forth in claim 14, wherein:

the strap detachably couples the frame with a microphone by enfolding the strap around the microphone, and pressing the miniature clasps at the first distal end of the first side of the strap against the miniature hooks at the second distal end of the second side.

20. The filter assembly as set forth in claim 11, wherein:

the filter assembly is a side-address microphone filter assembly.

21. A filter assembly, comprising:

a frame that is used with a side-address microphone;

the frame forming the outer perimeter of the filter assembly, the frame is comprised a first frame structure having one of a soft and firm material and a second frame structure having one of firm and soft material, with the soft material facing the side-address microphone;

a filter enclosed in between the first frame structure and the second frame structure; and a strap comprised of a second soft material that is attached with the frame for detachably coupling the frame with a microphone;

the first frame structure further includes a first extension that is integral with the first frame structure, forming a first single unitary piece frame casing;

the second frame structure further includes a second extension that is integral with the second frame structure, forming a second single unitary piece frame casing;

the first extension is aligned with the second extension to form a single pair;

the strap is further comprised of:

a first side that includes miniature clasps at a first distal end;

a second side that includes miniature hooks at a second distal end;

the second distal end of the strap is attached with the first and the second extension of the frame;

the strap detachably couples the frame with the microphone by enfolding the strap around the microphone, and pressing the miniature clasps at the first distal end of the first side of the strap against the miniature hooks at the second distal end of the second side.

* * * * *